US007299812B2

(12) United States Patent
Carter

(10) Patent No.: US 7,299,812 B2
(45) Date of Patent: Nov. 27, 2007

(54) ERECTABLE SHELTER WITH THREE WAY AWNING

(76) Inventor: Mark C. Carter, 1601 Iowa Ave., Riverside, CA (US) 92507

( * ) Notice: Subject to any disclaimer, the term of this patent is extended or adjusted under 35 U.S.C. 154(b) by 261 days.

(21) Appl. No.: 10/993,922

(22) Filed: Nov. 19, 2004

(65) Prior Publication Data

US 2006/0118155 A1 Jun. 8, 2006

(51) Int. Cl.
*E04H 15/50* (2006.01)
*E04H 15/58* (2006.01)

(52) U.S. Cl. ..... 135/117; 135/147; 135/155; 135/120.3; 403/385; 403/400; 248/229.13; 160/45

(58) Field of Classification Search ..... 135/97, 135/131, 141–147, 151, 155–158, 117, 120.3, 135/119; 403/385, 400; 248/278.1, 229.13, 248/229.23; 160/45, 65, 76
See application file for complete search history.

(56) References Cited

U.S. PATENT DOCUMENTS

| | | | | |
|---|---|---|---|---|
| 1,846,011 | A * | 2/1932 | Adams | 135/158 |
| 2,151,908 | A * | 3/1939 | Gottlieb | 135/136 |
| 3,182,672 | A * | 5/1965 | Biller, Jr. | 135/117 |
| 5,035,253 | A * | 7/1991 | Bortles | 135/119 |
| 5,490,533 | A | 2/1996 | Carter | |
| 5,555,679 | A * | 9/1996 | Scherba | 52/2.18 |
| 6,216,374 | B1 * | 4/2001 | Lawrence | 40/604 |
| 6,478,039 | B2 * | 11/2002 | Suh | 135/120.3 |
| 6,718,995 | B2 * | 4/2004 | Dotterweich | 135/131 |
| 7,055,538 | B2 * | 6/2006 | Deng | 135/131 |
| 7,069,679 | B2 * | 7/2006 | Haggard, Jr. | 40/604 |
| 2002/0092555 | A1 * | 7/2002 | Chen et al. | 135/144 |

FOREIGN PATENT DOCUMENTS

| | | |
|---|---|---|
| FR | 2805559 | * 8/2001 |
| GB | 2362395 | * 11/2001 |

OTHER PUBLICATIONS

E-Z Up Graphic Accessories, custom banners, sky banners, flag banners, table covers, 2003.
E-Z Up Instant Shelter Owner's Manual, Sky Banner, 2003.

* cited by examiner

*Primary Examiner*—Winnie Yip
(74) *Attorney, Agent, or Firm*—Fulwider Patton LLP

(57) ABSTRACT

The erectable shelter includes an awning assembly for a shelter that is removably mounted to two or more adjacent legs of the shelter. The awning assembly is mounted so that it can be moved between a downwardly directed vertical position and an upwardly directed vertical position, and to an intermediate horizontal position between the downwardly directed vertical position and an upwardly directed vertical position, allowing the awning to provide shade and to serve as a holder for signage.

24 Claims, 4 Drawing Sheets

ERECTABLE SHELTER WITH THREE WAY AWNING

BACKGROUND OF THE INVENTION

1. Field of the Invention

This invention relates generally to folding, collapsible structures, and more particularly relates to an awning assembly for a shelter having a canopy portion with an upper framework, and at least two adjacent legs supporting the canopy portion, the awning assembly adapted to be removably mounted to at least two adjacent legs.

2. General Background and State of the Art

Temporary shelters that can be easily transported and rapidly set up at emergency sites can be particularly useful in providing temporary care and housing. Such shelters can also be useful for non-emergency outdoor gatherings, such as for temporary military posts, field trips, and the like. It would be desirable to provide an improved collapsible shelter with a multipurpose awning that can be moved to different positions to provide shade and to serve as a holder for signage. It would also be desirable to provide a modular multipurpose awning that is adapted to mounted to an existing shelter and that can be moved to different positions to provide shade and to serve as a holder for signage. The present invention fulfills these and other needs.

INVENTION SUMMARY

Briefly, and in general terms, the invention provides for an awning assembly for a shelter that is adapted to be removably mounted to two or more adjacent legs of the shelter. The awning is removably mounted so that it can be moved between a downwardly directed vertical position and an upwardly directed vertical position, and to an intermediate horizontal position between the downwardly directed vertical position and an upwardly directed vertical position, allowing the awning to provide shade and to serve as a holder for signage.

Accordingly, the present invention provides for an awning assembly for a shelter having a canopy portion with an upper framework, and two or more adjacent legs supporting the canopy portion, and the awning being adapted to be removably mounted to the two or more adjacent legs of the shelter. The present invention also provides for a combination of a shelter and an awning assembly.

The awning assembly includes left and right awning support arms, each awning support arm including an elongated rod portion with a proximal end portion for pivotally mounting the awning support arm to a corresponding one of the legs of the shelter, and an awning shade portion removably mounted to the left and right awning support arms. The left and right awning support arms and the awning shade portion are advantageously movable between a downwardly directed vertical position and an upwardly directed vertical position, and in a presently preferred aspect, are movable to an intermediate horizontal position between the downwardly directed vertical position and an upwardly directed vertical position.

In a preferred aspect, the awning shade portion includes left and right side sleeves for receiving the left and right awning support arms, respectively. In a presently preferred aspect, the awning shade portion has opposing flat sides, and the awning shade portion further includes means for mounting a banner to one of the flat sides of the awning shade portion. In another presently preferred aspect, the means for mounting a banner includes a pouch formed of a sheet of clear plastic material attached to the one of the flat sides of the awning shade portion, and the pouch includes an opening for receiving the banner to be displayed. The awning shade portion may also include one or more fastener straps for securing the awning shade portion to the shelter.

The proximal end portion of the elongated rod portion comprises a connecting bracket having a leg connector portion for removable connection to one of the legs of the shelter, and an adjustable pivot mount portion in which the proximal end of the elongated rod portion is pivotally mounted. In a preferred aspect, the proximal end portion of the elongated rod portion comprises a cylindrical pivoting member pivotally mounted in the adjustable pivot mount portion. In another preferred aspect, the connecting bracket comprises a first journal arm, a second journal arm, and a center strut extending perpendicularly between the first journal arm and the second journal arm, the first journal arm including a first end on one side of the center strut, and a second end on an opposing side of the strut, and the second journal arm including a first end on the same side of the center strut as the first end of the first journal arm, and a second end terminating adjacent to the center strut, the cylindrical pivoting member being pivotally mounted between the first and second journal arms.

The first journal arm includes a locking arm having a first end and a second end, the first end being pivotally connected to the second end of the first journal arm, and the second end being removably connectable to the second end of the second journal arm. The second end of the locking arm comprises a tongue member projecting from the second end of the locking arm, and the second end of the second journal arm includes a corresponding slot that receives the tongue member. The tongue member includes a first hole, and the second end of the second journal arm includes a second hole that is aligned with the first hole when the tongue member is received in the slot, whereby the locking arm can be locked in a closed position, connecting the second end of the locking arm to the second journal arm. A threaded locking pin is adapted to be inserted through the second hole in second end of the second journal arm and through the first hole in the tongue member when the first and second holes are aligned. The locking arm has inner surface including a locking tab that is adapted to be received in a corresponding awning mounting hole formed in a desired location on the corresponding leg of the collapsible shelter.

In another presently preferred aspect, the adjustable pivot mount portion includes a clamping mechanism including a handle with a connecting shaft which is threadedly connected to the cylindrical pivoting member through a hole in the first journal arm, to thereby allow the cylindrical pivoting member to be clamped in a desired position.

Other features and advantages of the present invention will become more apparent from the following detailed description of the preferred embodiments in conjunction with the accompanying drawings, which illustrate, by way of example, the operation of the invention.

DETAILED DESCRIPTION OF THE PREFERRED EMBODIMENTS

Figure 1:
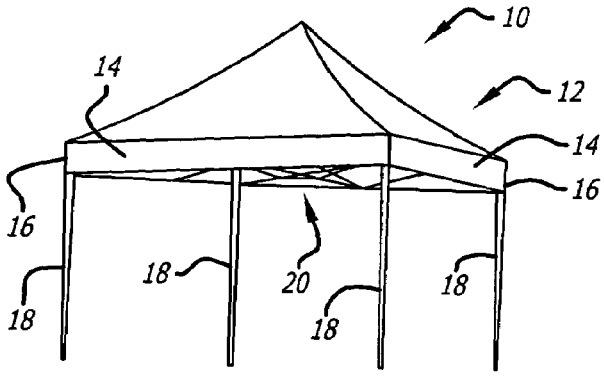
FIG. 1 (Prior Art)
FIG. 1 FIG. 1 is a perspective view of a prior art collapsible shelter.

As is illustrated in FIG. 1, a shelter, such as a prior art collapsible shelter 10, includes a canopy portion 12 with three or more sides 14, and three or more corners 16. Such a prior art collapsible shelter typically has four sides and four corners. Legs 18 are typically provided at each corner to support the canopy. A collapsible framework 20, typically including a perimeter truss framework and a central truss framework, is connected to the legs to stabilize and support the collapsible shelter.

Figure 2:
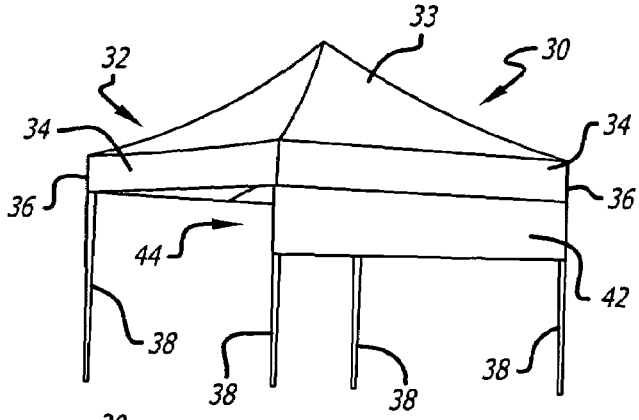
FIG. 2 is a perspective view of a collapsible shelter with a three-way awning according to the invention, with the awning shown in a downward vertical position.
Figure 3:
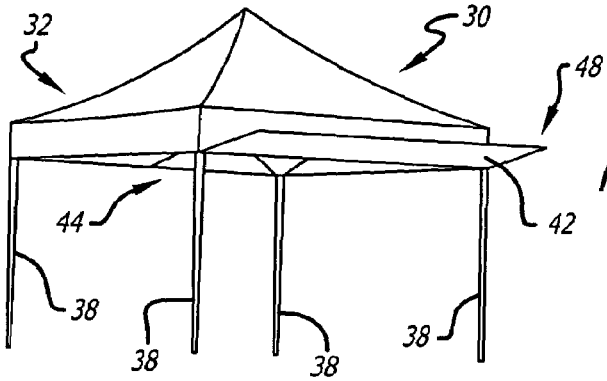
FIG. 3 is a perspective view of a collapsible shelter with a three-way awning according to the invention, with the awning shown in a horizontal position.
Figure 4:
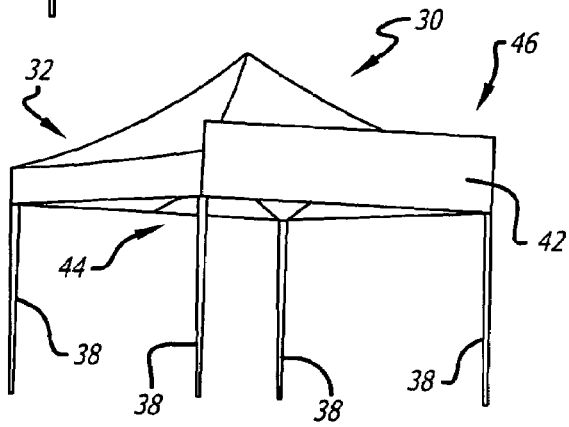
FIG. 4 is a perspective view of a collapsible shelter with a three-way awning according to the invention, with the awning shown in a upright vertical position.

Referring to FIGS. 2-4, the present invention provides for a shelter 30, such as a collapsible shelter, including a canopy portion 32 with three or more sides 34, and three or more corners 36. In a presently preferred aspect, the collapsible shelter has four sides and four corners. The canopy portion includes a canopy cover 33 typically formed of nylon fabric, so as to be light and easily transportable, although the canopy portion may be made of other similar sheet materials, such as canvass, or other types of cloth fabric, or plastic. Legs 38 are typically provided at each corner to support the canopy. The canopy portion also includes a collapsible framework 40, including a perimeter truss framework and a central truss framework, is connected to the legs to stabilize and support the collapsible shelter, as is described in U.S. Pat. No. 5,490,533, which is incorporated by reference herein.

As is illustrated in FIG. 2-4, the present invention also provides for a three-way awning 42 that can be mounted to two adjacent legs of the collapsible shelter. Once mounted to the legs of the collapsible shelter, the awning can moved between a downwardly directed vertical position 44, shown in FIG. 2, and an upwardly directed vertical position 46, shown in FIG. 4. The awning can also be moved to an intermediate horizontal position 48, shown in FIG. 3.

Figure 5:
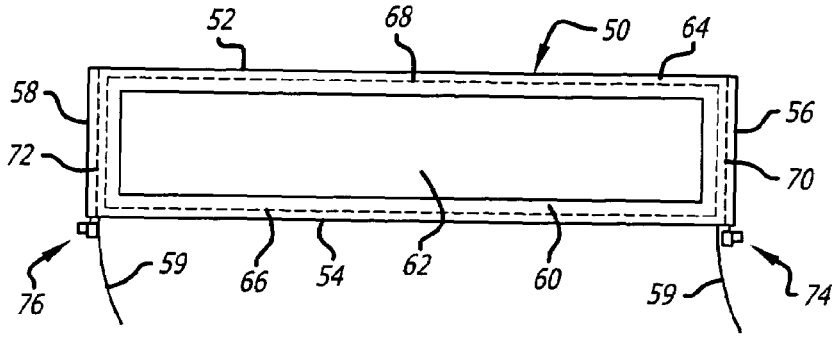
FIG. 5 is a top plan view of the three-way awning of FIG. 2.
Figure 7:
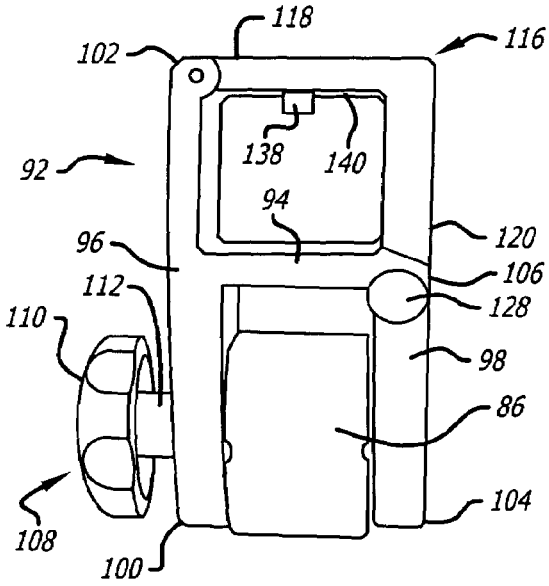
FIG. 7 is a top plan view of the connecting bracket of the left support arm of FIG. 6A, in a closed configuration.
Figure 6A:
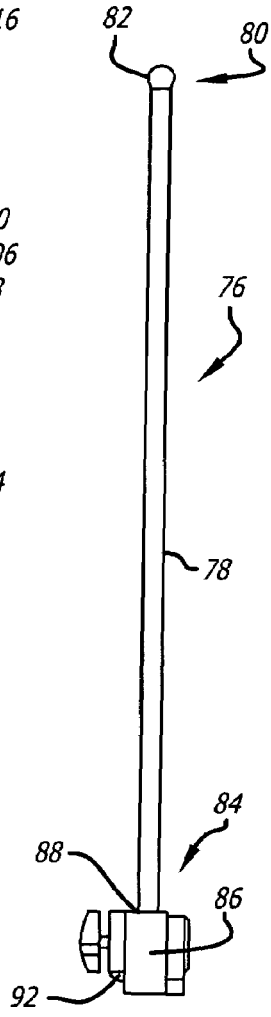
FIG. 6A is a top plan view of the left support arm of the three-way awning of FIG. 5.
Figure 6B:
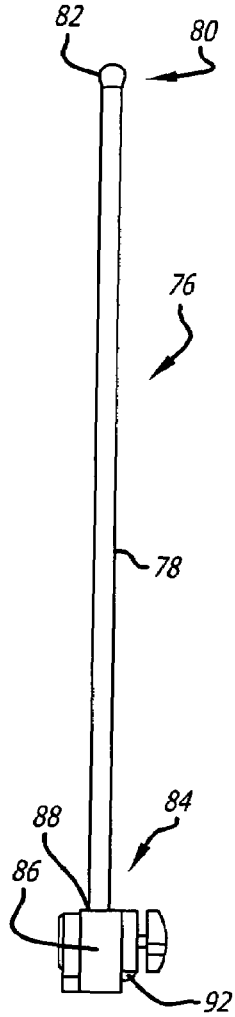
FIG. 6B is a top plan view of the right support arm of the three-way awning of FIG. 5.
Figure 8:
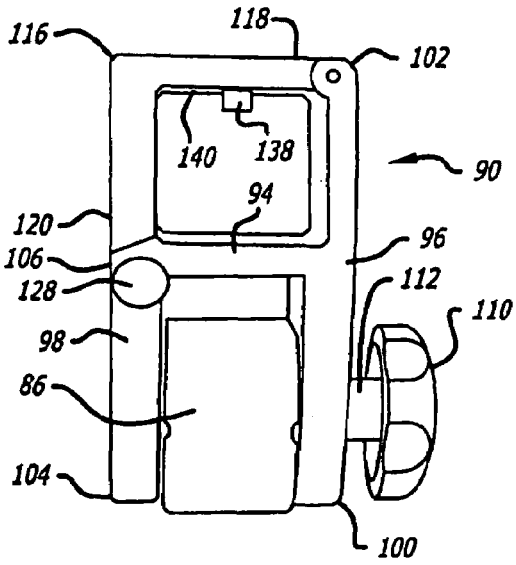
FIG. 8 is a top plan view of the connecting bracket of the right support arm of FIG. 6B, in a closed configuration.
Figure 9:
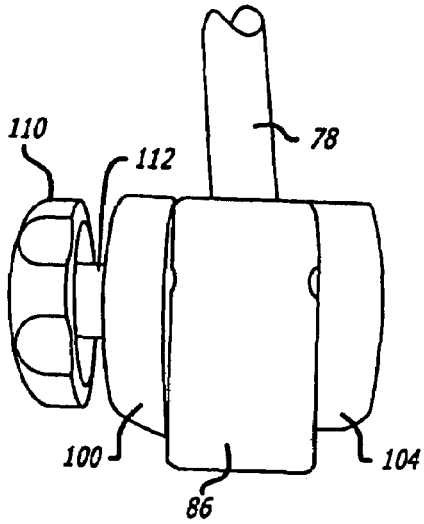
FIG. 9 is a rear view of the connecting bracket of the left support arm of FIG. 6A, in a closed configuration.

Referring to FIG. 5, the awning includes an awning shade portion 50, which is typically generally rectangular, having a length along an outer side 52 and an inner side 54, and a width along a left side 56 and a right side 58. One or more fastener straps 59 may be attached to the inner side, or the left or right sides, for further securing the awning shade portion to the framework or legs of the shelter. The fastener straps currently preferably include hook and loop fasteners, but may alternatively be straps with other types of fasteners, such as snaps or buttons, for example. Alternatively, the awning shade portion may take other geometric or artistic forms, as desired. The awning shade portion is typically made of a nylon fabric, similar to the material of the canopy cover, although the awning shade portion may likewise be made of other similar sheet materials of one or more plys, such as canvass, or other types of cloth fabric, or plastic. In one aspect, the awning shade portion advantageously includes a means 60 for mounting a banner 62 to a flat side 64 of the awning shade portion, such as a pouch 66, typically formed of a sheet of clear plastic material attached to the flat side of the awning shade portion at at least two sides of the pouch, leaving at least one side 68 of the pouch open for receiving the banner to be displayed. The awning shade portion also advantageously includes left and right side sleeves 70, 72, for receiving left awning support arm 74 and right awning support arm 76, respectively, illustrated in FIGS. 5, 6A and 6B. The left and right awning support arms include an elongated rod portion 78, having a distal end portion 80 typically covered with a protective cap 82. A proximal end portion 84 of the elongated rod portion of each of the left and right awning support arms is advantageously attached to a cylindrical pivoting member 86, which is pivotally mounted at a proximal end 88 to left and right connecting brackets 90, 92, respectively, which are illustrated in FIGS. 7-11.

The left and right connecting brackets are substantially mirror images of each other, so that only the connecting bracket of the right support arm will be described in detail. The connecting bracket of the right support arm, shown in a closed configuration in FIG. 7, includes a center strut 94 extending perpendicularly between a first journal arm 96 and a second journal arm 98, between which the cylindrical pivoting member is pivotally mounted. The first journal arm includes a first end 100 on one side of the center strut, and a second end 102 on the opposing side of the strut. The second journal arm includes a first end 104 on the same side of the center strut as the first end of the first journal arm, and a second end 106 terminating adjacent to the center strut. A clamping mechanism 108 includes a generally circular handle or dial 110 and a center shaft 112 which is threadedly connected to the cylindrical pivoting member through a hole in the first journal arm, to allow the cylindrical pivoting member to be clamped in a desired position, such as to set the right support extending from a leg in a downwardly projecting vertical position, an upwardly projecting vertical position, or in an intermediate position such as a horizontal intermediate position. The right connecting bracket also includes a locking arm 116 having a first end 118 pivotally connected to the second end of the first journal arm, and a second end 120 removably connectable to the second end of the second journal arm.

Figure 10:
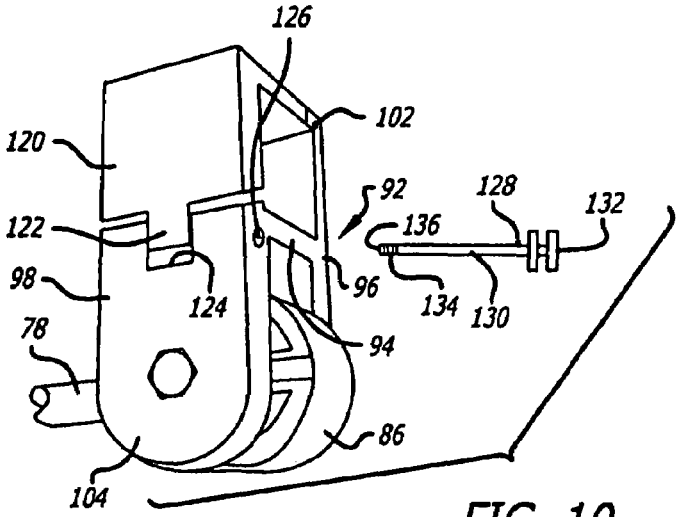
FIG. 10 is a perspective view of the connecting bracket of the right support arm of FIG. 6B, in a closed configuration.
Figure 11:
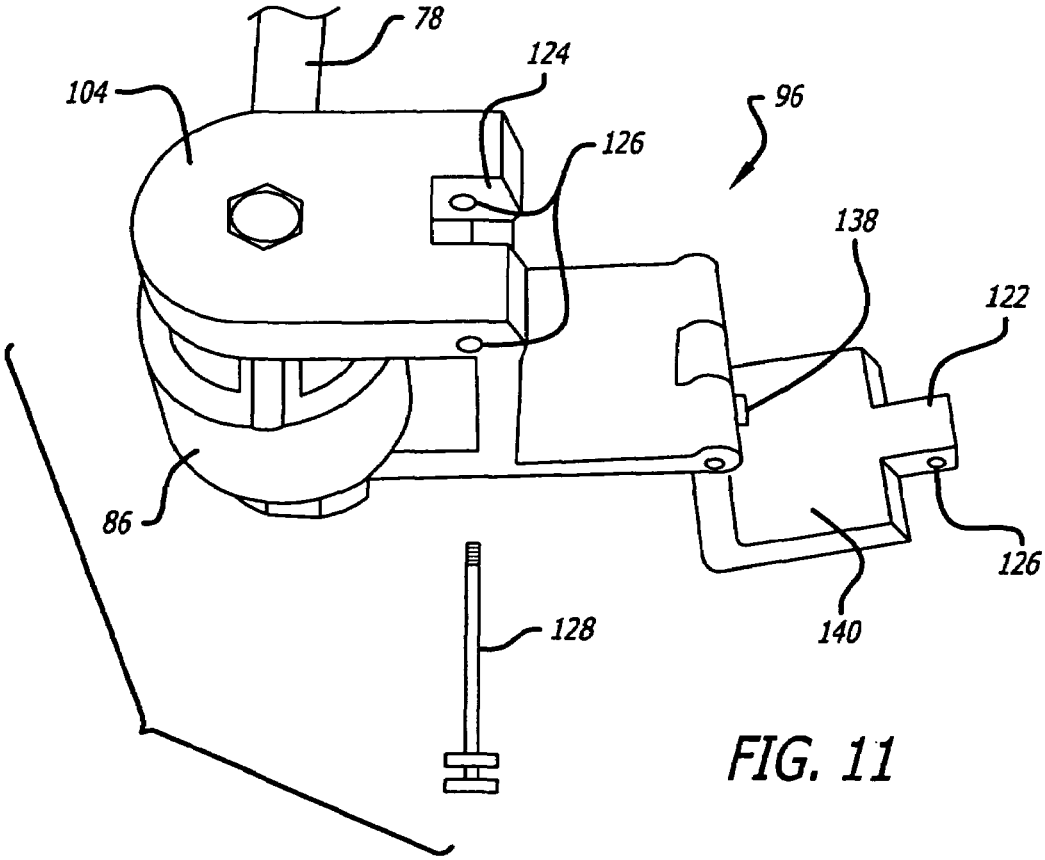
FIG. 11 is another perspective view of the connecting bracket of the right support arm of FIG. 6B, in an opened configuration.
Figure 12:
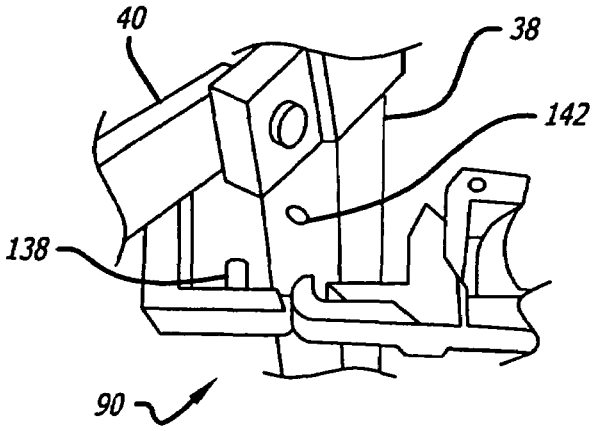
FIG. 12 is an illustration of the awning mounting hole on a leg of the collapsible shelter.

As is illustrated in FIGS. 10 and 11, in a currently preferred aspect, the second end of the locking arm includes a tongue member 122 projecting from the second end of the locking arm, and the second end of the second journal arm includes a corresponding groove or slot 124 that receives the tongue member. Extending through the tongue member is a hole 126, that is aligned with a corresponding hole through the second end of the second journal arm when the tongue member is received in the slot, allowing the locking arm to locked in a closed position, connecting the second end of the locking arm to the second journal arm, by insertion of a threaded locking pin 128 through the hole in second end of the second journal arm and through the hole in the tongue member. The threaded locking pin includes a shaft 130 with a head 132 at one end, and threads 134 at an opposing end 136 that mates with corresponding internal threads in the hole through the second journal arm second end. The locking arm currently preferably is a right angle member to conform to a corresponding right angle shape of a leg of the collapsible shelter, and includes a locking tab 138 on the inner surface 140 of the locking arm that is adapted to be received in a corresponding awning mounting hole 142 formed in a desired location on the leg of the collapsible shelter, shown in FIG. 12.

Thus, in an open configuration, the connecting bracket may be attached to the leg of the collapsible shelter by placing the center strut of the connecting bracket in abutment with the leg of the collapsible shelter, pivoting the locking arm of the connecting bracket to a closed configuration with the locking tab juxtaposed with and inserted in the corresponding hole on the leg of the collapsible shelter, placing the tongue member of the locking arm in the corresponding slot of the second journal arm, and securing the threaded locking pin through the hole in second end of the second journal arm and through the hole in the tongue member.

The three-way shelter awning can thus be mounted to the legs of an upright shelter, such as a collapsible shelter that has been set up, by locating the awning mounting holes in adjacent legs of the shelter, typically located just below the perimeter framework of the shelter. The left and right awning support arms are preferably mounted to the adjacent legs of the shelter with the dials of the clamping mechanisms of the connecting brackets facing outwardly from the shelter. With the connecting brackets in an open configuration, the center struts of the connecting brackets are placed in abutment with the legs opposite the awning mounting holes, and the locking arms are closed about the legs with the locking tabs inserted in the awning mounting holes. The locking pins of the connecting brackets are then dropped into the corresponding holes of the connecting brackets and the locking arms are secured by screwing the locking pins in the corresponding holes of the connecting brackets. The awning support arms may then be rotated to extend in a horizontal intermediate position, and the dials of the clamping mechanisms of the support arms are turned to secure the support arms in position. The awning fabric may then be mounted to the support arms by sliding the sleeves of the awning over the support arms, with the banner pouch facing the ground. The fastener straps of the awning can then be looped around and fastened to appropriate portions of the shelter perimeter framework or the legs of the shelter to further secure the fabric of the awning to the shelter.

After the three-way shelter awning is installed on the legs of the shelter, the awning can be rotated to a downwardly directed vertical position to provide additional shade, such as to block sunlight from a rising or setting sun, for example, or can be rotated to an upwardly directed vertical position to display a banner inserted in the banner pouch. The clamping mechanisms of the support arms can be loosened by turning the dials of the clamping mechanisms counterclockwise, the support arms then can be rotated downward or upward to the desired position, and then the clamping mechanisms of the support arms can be tightened by turning the dials of the clamping mechanisms clockwise. When a banner or other signage is to be displayed in the banner pouch, the banner or other signage can be inserted in the banner pouch when the awning is in the horizontal intermediate position, after which the awning is rotated upwardly, or can be inserted in the banner pouch when the awning is in the upwardly directed vertical position.

It will be apparent from the foregoing that while particular forms of the invention have been illustrated and described, various modifications can be made without departing from the spirit and scope of the invention. Accordingly, it is not intended that the invention be limited, except as by the appended claims.

I claim:

1. An awning assembly for a shelter having a canopy portion with an upper framework, and at least two adjacent legs supporting the upper framework, the awning assembly adapted to be removably mounted to said at least two adjacent legs, comprising:

left and right awning support arms, each said awning support arm including an elongated rod portion with a distal end portion and a proximal end portion including means for pivotally mounting the awning support arm to a corresponding one of the legs of the shelter, said means for pivotally mounting the awning support arm including a connecting bracket having a leg connector portion for removable connection to one of the legs of the shelter, and an adjustable pivot mount portion in which the proximal end of the elongated rod portion is pivotally mounted, said proximal end portion of said elongated rod portion further including a cylindrical pivoting member pivotally mounted in said adjustable pivot mount portion, and said connecting bracket including a first journal arm, a second journal arm, and a center strut extending perpendicularly between the first journal arm and the second journal arm, the first journal arm including a first end on one side of the center strut, and a second end on an opposing side of the strut, and the second journal arm including a first end on the same side of the center strut as the first end of the first journal arm, and a second end terminating adjacent to the center strut, the cylindrical pivoting member being pivotally and adjustably mounted in said adjustable pivot mount portion formed between the first ends of the first and second journal arms, said leg connector portion including a locking arm pivotally connected between the second ends of the first and second journal arms; and an awning shade portion removably mounted to said left and right awning support arms, said left and right awning support arms and said awning shade portion being movable between a downwardly directed vertical position and an upwardly directed vertical position.

2. The awning assembly of claim 1, wherein said left and right awning support arms and said awning shade portion are movable to an intermediate horizontal position between said downwardly directed vertical position and an upwardly directed vertical position.

3. The awning assembly of claim 1, wherein said an awning shade portion comprises left and right side sleeves for receiving said left and right awning support arms, respectively.

4. The awning assembly of claim 1, wherein said awning shade portion has opposing flat sides, and said awning shade portion further comprises means for mounting a banner to one of said flat sides of said awning shade portion.

5. The awning assembly of claim 4, wherein said means for mounting a banner comprises a pouch formed of a sheet of clear plastic material attached to said one of said flat sides of said awning shade portion, and the pouch having an opening for receiving the banner to be displayed.

6. The awning assembly of claim 1, wherein said awning shade portion comprises at least one fastener strap adapted for securing the awning shade portion to the shelter.

7. The awning assembly of claim 1, wherein said locking arm of said leg connector portion has a first end and a second end, said first end being pivotally connected to the second end of the first journal arm, and said second end being removably interlocked to the second end of the second journal arm.

8. The awning assembly of claim 7, wherein the second end of the locking arm comprises a tongue member projecting from the second end of the locking arm, and the second end of the second journal arm includes a corresponding slot that receives the tongue member.

9. The awning assembly of claim 8, wherein said tongue member includes a first hole, and the second end of the second journal arm includes a second hole that is aligned with said first hole when the tongue member is received in the slot, whereby the locking arm can be locked in a closed position, connecting the second end of the locking arm to the second journal arm.

10. The awning assembly of claim 9, further comprising a threaded locking pin adapted to be inserted through the second hole in second end of the second journal arm and through the first hole in the tongue member when the first and second holes are aligned.

11. The awning assembly of claim 7, wherein said locking arm and comprises an inner surface defining a locking tab that is adapted to be received in a corresponding awning mounting hole formed in a desired location on the corresponding leg of the collapsible shelter.

12. The awning assembly of claim 1, wherein said adjustable pivot mount portion comprises a clamping mechanism including a handle with a connecting shaft which is threadedly connected to the cylindrical pivoting member through a hole in the first journal arm, to thereby allow the cylindrical pivoting member to be clamped in a desired position.

13. In a combination of a shelter and an awning assembly, the shelter having a canopy portion with an upper framework, and at least two adjacent legs supporting the upper framework, the awning assembly being removably mounted to said at least two adjacent legs of the shelter, the improvement comprising:

left and right awning support arms, each said awning support arm including an elongated rod portion with a distal end portion and a proximal end portion including means for pivotally mounting the awning support arm to a corresponding one of the legs of the shelter, said means for pivotally mounting the awning support arm including a connecting bracket having a leg connector portion for removable connection to one of the legs of the shelter, and an adjustable pivot mount portion in which the proximal end of the elongated rod portion is pivotally mounted, said proximal end portion of said elongated rod portion further including a cylindrical pivoting member pivotally mounted in said adjustable pivot mount portion, and said connecting bracket including a first journal arm, a second journal arm, and a center strut extending perpendicularly between the first journal arm and the second journal arm, the first journal arm including a first end on one side of the center strut, and a second end on an opposing side of the strut, and the second journal arm including a first end on the same side of the center strut as the first end of the first journal arm, and a second end terminating adjacent to the center strut, the cylindrical pivoting member being pivotally and adjustably mounted in said adjustable pivot mount portion formed between the first ends of the first and second journal arms, said leg connector portion including a locking arm pivotally connected between the second ends of the first and second journal arms; and an awning shade portion removably mounted to said left and right awning support arms, said left and right awning support arms and said awning shade portion being movable between a downwardly directed vertical position and an upwardly directed vertical position.

14. The combination of claim 13, wherein said left and right awning support arms and said awning shade portion are movable to an intermediate horizontal position between said downwardly directed vertical position and an upwardly directed vertical position.

15. The combination of claim 13, wherein said an awning shade portion comprises left and right side sleeves for receiving said left and right awning support arms, respectively.

16. The combination of claim 13, wherein said awning shade portion has opposing flat sides, and said awning shade portion further comprises means for mounting a banner to one of said flat sides of said awning shade portion.

17. The combination of claim 16, wherein said means for mounting a banner comprises a pouch formed of a sheet of clear plastic material attached to said one of said flat sides of said awning shade portion, and the pouch having an opening for receiving the banner to be displayed.

18. The combination of claim 13, wherein said awning shade portion comprises at least one fastener strap adapted for securing the awning shade portion to the shelter.

19. The combination of claim 13, wherein said locking arm of said leg connector portion has a first end and a second end, said first end being pivotally connected to the second end of the first journal arm, and said second end being removably interlocked to the second end of the second journal arm.

20. The combination of claim 19, wherein the second end of the locking arm comprises a tongue member projecting from the second end of the locking arm, and the second end of the second journal arm includes a corresponding slot that receives the tongue member.

21. The combination of claim 20, wherein said tongue member includes a first hole, and the second end of the second journal arm includes a second hole that is aligned with said first hole when the tongue member is received in the slot, whereby the locking arm can be locked in a closed position, connecting the second end of the locking arm to the second journal arm.

22. The combination of claim 21, further comprising a threaded locking pin adapted to be inserted through the second hole in second end of the second journal arm and through the first hole in the tongue member when the first and second holes are aligned.

23. The combination of claim 19, wherein said locking arm comprises an inner surface defining a locking tab that is adapted to be received in a corresponding awning mounting hole formed in a desired location on the corresponding leg of the collapsible shelter.

24. The combination of claim 13, wherein said adjustable pivot mount portion comprises a clamping mechanism including a handle with a connecting shaft which is threadedly connected to the cylindrical pivoting member through a hole in the first journal arm, to thereby allow the cylindrical pivoting member to be clamped in a desired position.

* * * * *